United States Patent [19]

Cotton

[11] 4,039,268

[45] Aug. 2, 1977

[54] ARRANGEMENT FOR ENDWISE CLAMPING A FIRST GAS TURBINE ROTOR MEMBER TO ANOTHER MEMBER OF A GAS TURBINE ROTOR

[75] Inventor: John Lee Cotton, Kongsberg, Norway

[73] Assignee: A/S Kongsberg Vapenfabrik, Kongsberg, Norway

[21] Appl. No.: 659,003

[22] Filed: Feb. 18, 1976

[30] Foreign Application Priority Data

Feb. 20, 1975 Norway ..... 750570

[51] Int. Cl.[2] ..... F01D 5/06

[52] U.S. Cl. ..... 416/183; 416/135; 416/244 A

[58] Field of Search ..... 416/183, 244 A, 131, 416/133, 135, 199, 200 A, 201; 403/50, 51, 205, 220, 291

[56] References Cited

U.S. PATENT DOCUMENTS

| | | | |
|---|---|---|---|
| 2,602,683 | 7/1952 | Aue | 416/183 |
| 2,619,317 | 11/1952 | Traupel | 416/244 A X |
| 2,861,823 | 11/1958 | Perry | 416/135 |
| 3,628,886 | 12/1971 | Andvig | 416/244 A X |
| 3,677,662 | 7/1972 | Cronstedt | 416/244 A X |
| 3,677,663 | 7/1972 | Cronstedt | 416/244 A X |
| 3,846,044 | 11/1974 | Shank | 416/199 |
| Re. 27,038 | 1/1971 | Newland | 416/183 X |

FOREIGN PATENT DOCUMENTS

| | | | |
|---|---|---|---|
| 74,422 | 7/1918 | Austria | 416/214 A |
| 1,053,712 | 3/1959 | Germany | 416/244 |
| 1,275,720 | 8/1968 | Germany | 416/183 |
| 30,048 | 5/1972 | Japan | 416/183 |

*Primary Examiner*—Everette A. Powell, Jr.

[57] ABSTRACT

An improved resilient member is provided in a clamping connection between two members of a gas turbine rotor, said resilient member taking the form of a rim or outer ring provided with an annular row of inwardly protruding fingers. The resiliency is due partly to deflection of the fingers and partly to a twisting of the outer ring with the fingers.

6 Claims, 2 Drawing Figures

ARRANGEMENT FOR ENDWISE CLAMPING A FIRST GAS TURBINE ROTOR MEMBER TO ANOTHER MEMBER OF A GAS TURBINE ROTOR

FIELD OF THE INVENTION

The present invention relates to an arrangement for endwise clamping a first gas turbine rotor member having a hub with a central bore, to another member of a gas turbine rotor to maintain said members in firm torque transmitting engagement with each other over an annular engagement area lying in a radial plane between the members, said arrangement comprising connecting means secured to said other member and protruding from the end face thereof into said central bore, said connecting means transferring an axial clamping force to said first rotor member.

BACKGROUND OF THE INVENTION

Blade wheels in radial flow gas turbines are for convenience in manufacture often made in two sections which are assembled by being clamped together endwise. The clamping may for instance be effected by connecting means including a bolt or sleeve secured to and protruding from the end face of the hub of one section, which may be a turbine wheel section, and extending through a central bore in the hub of the other section, which may be an educer wheel section. The axial clamping or connecting means may also include a resilient compression sleeve surrounding the connecting bolt or sleeve, one end of said compression sleeve engaging a first shoulder in the bore of the educer wheel section and the other end engaging a second shoulder at the end of the connecting bolt or sleeve. Such as assembly is disclosed in U.S. Pat. No. 3,628,886 and GB Pat. specification No. 1,292,858.

When the gas turbine is put into operation the sections and the connecting means will be heated and expand in the axial direction. When the turbine has been in operation for some time a steady state is reached in which the connecting bolt or sleeve is usually somewhat hotter than the hub of the educed wheel section. The difference in temperature $T_{conn}-T_{hub}$ depends upon the load on the turbine and attains its maximum value at full load. This difference in temperature is due to the fact that the connecting bolt or sleeve is directly connected to the first or turbine wheel section with which the hot combustion gases are first contacted, and which, therefore, will be hotter than the hub of the educer wheel section. However, when the cold turbine is put into operation the educer wheel section will during a transient period be hotter than the elements of the connecting means directly connected to the turbine wheel section. Thus, $T_{conn}-T_{hub} < 0$. Conversely, the temperature $T_{hub}$ in the educer wheel section will drop more rapidly than the temperature $T_{conn}$ in these connecting elements when the load on the turbine is reduced from full load to zero load. In a transient period the difference in temperature between the connecting elements and the hub of the educer wheel ($T_{conn}-T_{hub}$) will therefore be still larger than in the steady state at full load.

Because of heat elongation these variations in temperature entail a large variation in the axial clamping force provided between the two sections by the connecting means. Thus, substantial problems are encountered with respect to the axial clamping. On one hand the clamping force should not fall below a certain minimum value. If, on the other hand, the elongation of the hub of the educer wheel section resulting from the heat expansion is to its full extent imposed on the connecting sleeve, stresses far exceeding the yield point are created in the connecting sleeve, thereby producing a permanent elongation of the connecting sleeve and a loosening of the clamping when the connecting sleeve again becomes hotter than the hub ($T_{conn}-T_{hub} > 0$).

To avoid this, the U.S. and G.B. patent specifications referred to teach that as little as possible of the elongation of the hub of the educer wheel should be transmitted to the connecting sleeve. This is achieved by so positioning said first shoulder within the bore that said shoulder is spaced only a short axial distance from the radial plane of the torque transmitting engagement area, and dimensioning said resilient compression sleeve to have such clearances relative to the bore of the hub and the connecting sleeve, respectively, that the compression sleeve will obtain a temperature much closer to the temperature of the connecting sleeve than to the temperature of the hub. In this manner the heat elongation which is imposed on the connecting sleeve when the negative difference in temperature between the connecting sleeve and the hub attains its maximum absolute value is substantially reduced, since only a small portion of the heat elongation of the hub is transmitted to the connecting sleeve, the compression sleeve at the same time serving as a resilient member relieving the connecting sleeve.

However, in connection with the development of large radial flow gas turbines having higher temperatures it has proved that the transient temperature differences require resilient members having a substantially larger resiliency than what can be obtained by such a compression sleeve. It is true that the resiliency of the clamping may be increased by using a series of co-axial sleeves mutually engaging each other at the ends, for instance an inner and an outer compression sleeve and an intermediate tension sleeve, but since the size and the operating conditions of radial flow gas turbines presently under development may require the connecting means to accommodate a variation in the axial dimension of as much as 5 to 10 times the elastic compression which may be obtained by an ordinary compression sleeve, said solution using several co-axial sleeves is not practicable, as it would require more space than available.

SUMMARY OF THE INVENTION

An object of the present invention is to provide a clamping arrangement of the kind initially referred to having a novel resilient member which alone, or possibly together with a compression sleeve as disclosed in the U.S. and G.B. patent specifications referred to, may provide the required resiliency. The dimensional variation required may be in the order of for instance 0.5 to 1.0 mm even if the resilient member engages a shoulder which is spaced only a short axial distance from the radial plane of the torque transmitting engagement area.

According to the invention this requirement is met by a resilient member in the form of a rim axially engaging said hub of the first rotor member and provided with an annular row of inwardly protruding fingers. A further member forming part of the clamping connecting means, for instance a compression sleeve surrounding said connecting means, is in axial force transmitting engagement with the inner ends of the fingers. The rim preferably engages a radial shoulder within the bore of the hub of said first rotor member. Already as a consequence of the deflection of the fingers there will be obtained a substantial resiliency. However, an even greater resiliency is obtained due to a twisting of the rim. In order to facilitate this twisting the inner diameter of the radial shoulder may be larger than the inner diameter of the rim, so that the cross-section of the rim may tilt or roll about the free inner edge of the shoulder.

The fingers extend generally in a radial plane and are narrowly spaced from each other. They preferably have an increasing width and thickness in the outward direction towards the rim. The fingers are conical in both planes for the stresses to be constant. Thereby the material is utilized to its maximum.

BRIEF DESCRIPTION OF THE DRAWINGS

An embodiment of the arrangement according to the invention will now be described, reference being had to the accompanying drawings.

DETAILED DESCRIPTION OF THE PREFERRED EMBODIMENT

Figure 1:
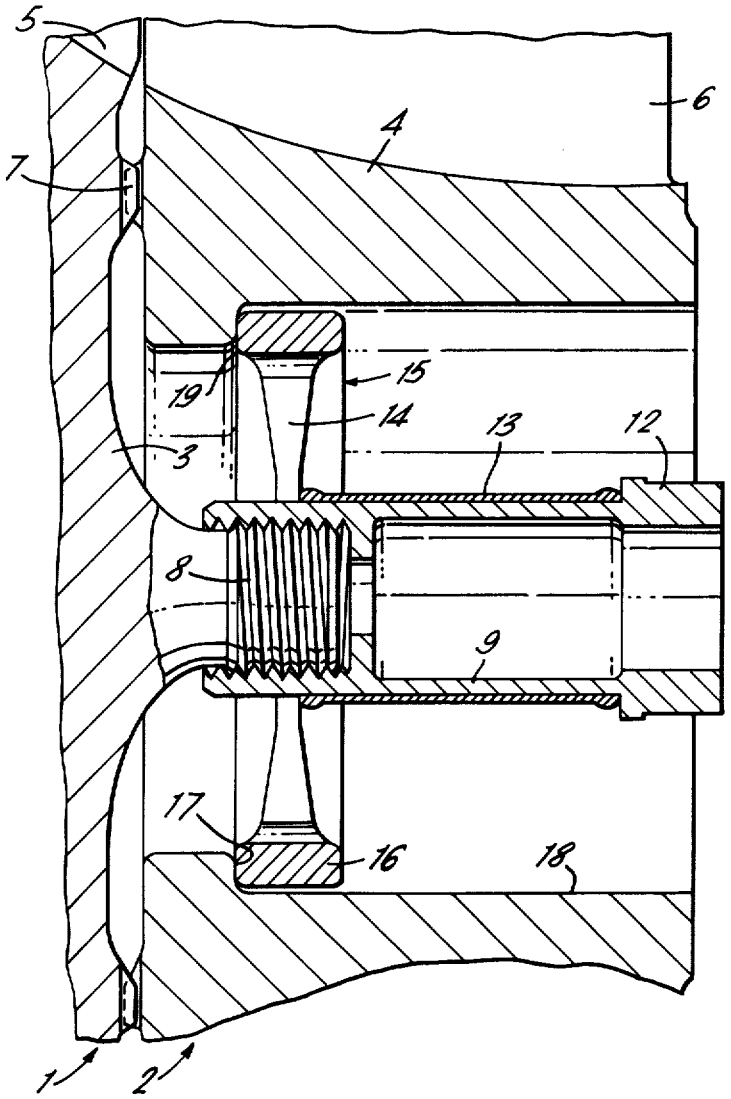
FIG. 1 is a fragmentary view of a turbine blade wheel for a radial flow gas turbine in axial cross-section.

The turbine blade wheel illustrated in the drawing is part of a larger turbine rotor and is assembled from two sections, a turbine wheel section 1 and an educer wheel section 2, each having a hub 3 and 4, respectively, and vanes or blades 5 and 6, respectively. The hubs 3 and 4 are kept in firm torque transmitting engagement with each other over an annular engagement area lying in a radial plane and having the form of a known centering tooth coupling 7 (Hirth coupling). The hub 3 has a centrally protruding threaded stub shaft 8 onto which there is threaded a connecting element in the form of a sleeve 9. The sleeve 9 may form a tension element in the connection means between the sections as shown in the U.S. and G.B. patent specifications previously referred to, but in the embodiment illustrated the sleeve is made with relatively thick walls so as to be lowly stressed by tensioning forces but in return permitting transmission of torque, if desirable.

At its outer end (the end to the right in FIG. 1) the connecting sleeve 9 has an enlarged head portion 12 having an outer hexagonal shape to permit the sleeve to be threaded onto the threaded stub shaft 8 on the hub 3. The head portion 12 also forms a shoulder engaging a compression sleeve 13 surrounding the connecting sleeve 9 with a very small clearance or being a sliding fit thereon and thus having at all times substantially the same temperature as the connecting sleeve 9. The compression sleeve 13 has slightly enlarged end portions and is prevented from buckling by the relatively stiff connecting sleeve 9. The end of the compression sleeve 13 opposite the head portion engages the inner ends of fingers 14 of a resilient member 15. The fingers 14 protrude radially inwardly from an outer annular portion or rim 16 of the member 15. The rim 16 engages a shoulder 17 in a bore 18 in the hub 4, said shoulder extending in a radial plane. The shoulder 17 has an inner or minor diameter which is larger than the inner diameter of the rim 16, so that the cross-section of the rim may tilt or roll about the free inner edge 19 of the shoulder.

Thus, the axial force required to keep the sections 1 and 2 in centering and torque transmitting engagement with each other through the teeth coupling 7 is transmitted from the head portion 12 of the connecting sleeve 9 through the compression sleeve 13 and the member 15 to the shoulder 17. Since this shoulder 17 is spaced a short axial distance from the radial plane through the teeth coupling 7 the axial heat expansion of the hub 4 will only to a small extent be transmitted to the means connecting the hubs. Correspondingly, axial contractions of the hub 4 relatively to the connecting sleeve 9 at lower temperatures in the hub 4 than in the sleeve ($T_{conn} - T_{hub} > 0$) will only to a limited extent influence the clamping force between the hubs. Still, a substantial resiliency in the connecting means is required in order to provide a sufficient axial clamping force on the teeth coupling 7 at the highest positive difference between the temperatures in the connecting sleeve 9 and the hub 4, respectively, and on the other hand not to cause an excessive axial clamping force which may stress any of the members of the connecting means beyond the yield point at the highest negative difference between the temperatures referred to. The illustrated compression sleeve 13 provides a certain resiliency due to axial compression, but the largest resiliency is provided by the member 15. Firstly, the fingers 14 will be subjected to a pure bending stress deflecting the fingers. A fact of even greater importance is that because the diameter of the rim is large compared with the cross-section thereof the rim 16 of the member 15 may twist considerably, the cross-section of the rim tilting or rolling about the edge 19. Thus, the total yield of the member 15 is composed of the twisting or tilting angle times the length of the fingers 14 and of the pure deflection of the fingers themselves.

Figure 2:
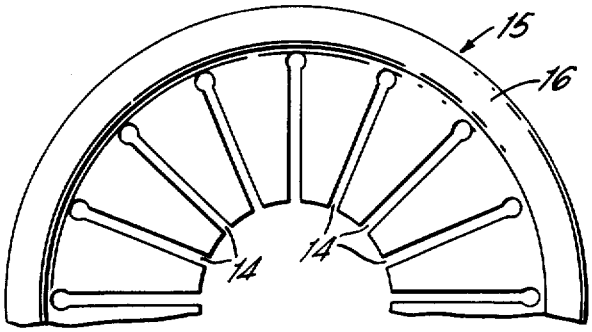
FIG. 2 is a fragmentary view of the rim with inwardly protruding fingers which is used as a resilient member in the assembly according to the invention.

As it will be apparent from FIG. 2 the fingers 14 are rather narrowly spaced from each other by uniformly wide slots between the fingers so that the fingers have a width or circumferential dimension increasing in the outward direction towards the rim 16. The slots are rounded at the bottom so as not to induce undue stresses. FIG. 1 also illustrates that the fingers 14 have an increasing thickness or axial dimension outwardly towards the rim. This increasing width and thickness of the fingers in the outward direction towards the rim 16 provides an optimal utilization of the material in the fingers, since the cross-section is adapted to the stresses to which the fingers are subjected. The member 15 may be manufactured by alloys such as "Nimonic 90" or "Waspaloy." The entire member 15 is very highly stressed and will in transient periods be subjected to stresses approximating the yield point at a temperature of 630° C. However, these transient periods are relatively short, and in steady state operation at full speed the loads are substantially lower, so that the creep will be satisfactorily small.

The member 15 is not simple or cheap in production, but provides a reliable resilient member having the required elasticity without excessive creep at the high loads and temperatures involved in large radial flow gas turbines at present being developed.

The cross-section of the rim 16 will influence the stresses arising in the member 15 and the yield obtained. Smaller dimensions will usually result in a greater yield and higher stresses, and the shape and dimensions of the rim section 16 must usually be chosen as a compromise between yield and stress considerations. The invention is, of course, not restricted to any specified number of fingers 14. Also in this respect a compromise between stresses and yield is involved, and the number of fingers 14 is generally chosen as high as possible without the stresses or the manufacturing difficulties becoming excessive.

What I claim is:

1. In a multi-part gas turbine rotor comprising a first gas turbine rotor member having a hub with a central bore; another rotor member, annular engagement areas between said rotor members and lying in a radial plane between said rotor members; and means for endwise clamping and maintaining said rotor members in firm, torque-transmitting engagement with each other over said annular engagement areas, said first rotor member central bore having a first shoulder facing away from said second rotor member, said second rotor member having connecting means projecting from an end face into said central bore and beyond said first shoulder, said second connecting means having a shoulder facing said second rotor member and said first shoulder, said connecting means including resilient means engaging both said shoulders, and securing means securely holding the two rotor members in assembled relation with said resilient means clamped between said shoulders, the improvement in which said resilient means includes a rim engaging said first shoulder and having an annular row of inwardly projecting lever portions, said lever portions having respective inner ends engaging said second shoulder.

2. An arrangement as claimed in claim 1, in which said first shoulder has a free inner edge defined by an inner diameter which is greater than the inner diameter of the rim, the rim being tiltable about the free inner edge of the shoulder.

3. An arrangement as claimed in claim 1, in which the lever portions extend generally in a radial plane and are spaced from each other.

4. An arrangement as claimed in claim 1, in which each lever portion has a circumferential dimension increasing in the radial direction towards the rim.

5. An arrangement as claimed in claim 1, in which each lever portion has an axial dimension increasing in the radial direction towards the rim.

6. An arrangement as claimed in claim 1, in which said second shoulder comprises the end of a compression sleeve surrounding a connecting sleeve secured to said second rotor member, said compression sleeve engaging a third shoulder at a free outer end of said connecting sleeve.

* * * * *